US005756635A

United States Patent [19]

Michaud et al.

[11] Patent Number: 5,756,635

[45] Date of Patent: May 26, 1998

[54] PROCESS FOR SPINNING FROM SOLUTION OF POLYAMIDE-IMIDES (PAI) BASED ON TOLYLENE OR MET-PHENYLENE DIISOCYANATES AND FIBRES THUS OBTAINED

[75] Inventors: Philippe Michaud; Marie-Eve Perier; Jean Russo, all of Lyon, France

[73] Assignee: Rhone-Poulenc Fibres, Cedex, France

[21] Appl. No.: 721,197

[22] Filed: Sep. 27, 1996

Related U.S. Application Data

[63] Continuation of Ser. No. 427,652, Apr. 21, 1996, abandoned, which is a continuation-in-part of Ser. No. 300,511, Sep. 6, 1994, abandoned, which is a continuation of Ser. No. 991,942, Dec. 17, 1992, abandoned.

[30] Foreign Application Priority Data

Dec. 24, 1991 [FR] France ..... 91 16339

[51] Int. Cl.[6] ..... C08G 18/08

[52] U.S. Cl. ..... 528/48; 528/49; 528/52; 528/310; 524/589; 524/590; 524/871; 524/873; 264/289.3; 264/184

[58] Field of Search ..... 528/44, 48, 71, 528/49, 52, 310; 524/589, 590, 871, 873; 264/289.3, 184

[56] References Cited

U.S. PATENT DOCUMENTS

| | | | |
|---|---|---|---|
| 3,673,160 | 6/1972 | Buisson et al. . | |
| 5,095,070 | 3/1992 | Barthelemy | 524/714 |

FOREIGN PATENT DOCUMENTS

| | | |
|---|---|---|
| 0360707 | 3/1990 | European Pat. Off. . |
| 1498015 | 12/1967 | France . |
| 1600067 | 7/1970 | France . |
| 2079785 | 11/1971 | France . |
| 0360708 | 3/1990 | France . |
| 2643089 | 8/1990 | France . |
| 1168978 | 10/1969 | United Kingdom . |
| 1301681 | 1/1973 | United Kingdom . |

*Primary Examiner*—Duc Truong
*Attorney, Agent, or Firm*—Watson Cole; Stevens Davis, P.L.L.C.

[57] ABSTRACT

The present invention relates to a process for obtaining PAI fibres by spinning PAI in solution and to the fibres thus obtained. They are obtained by dry or wet spinning into dimethylalkyleneurea followed by removal of the solvent and overdrawing at high temperature. The yarns and fibres obtained are produced from PAI based on tolylene or meta-phenylene diisocyanate, and on an aromatic acid anhydride and/or an aromatic dianhydride, and optionally on one or a number of diacid compounds. They exhibit an outstanding thermomechanical behavior and make it possible to gain access to very low linear densities.

35 Claims, No Drawings

PROCESS FOR SPINNING FROM SOLUTION OF POLYAMIDE-IMIDES (PAI) BASED ON TOLYLENE OR MET-PHENYLENE DIISOCYANATES AND FIBRES THUS OBTAINED

This application is a continuation of application Ser. No. 08/427,652, filed Apr. 21, 1996 (abandoned), which is a continuation-in-part of application Ser. No. 08/300,511, filed Sep. 6, 1994, now abandoned, which is a continuation of application Ser. No. 07/991,942, filed Dec. 17, 1992 now abandoned.

The present invention relates to a process for obtaining thermally stable fibres by spinning in solution of polyamide-imides and to the fibres thus obtained.

According to FR 2,079,785 it is known to manufacture lustrous yarns based on polyamide-imides containing at least 3% of chain sequences originating from an alkali or alkaline-earth metal 3,5-dicarboxybenzenesulphonate by wet spinning from a solution of polymer in N-methylpyrrolidone, into an aqueous bath also containing N-methylpyrrolidone, followed by drawing, washing and drying.

However, besides a strong yellow colouring, such yarns also have inadequate thermomechanical behaviour for some applications.

In addition, according to this patent it is not possible to obtain polyamide-imide fibres with good mechanical properties while employing tolylene and meta-phenylene diisocyanates as initial isocyanate.

To improve the mechanical properties of polyamide-imides fibres have also been prepared, according to FR 2,643,084, which are based on polyamide-imides preferably produced from 4,4'-diphenyl ether diisocyanate. However, such fibres exhibit a low drawability which does not make it possible to gain access to low linear densities.

Furthermore, 4,4'-diphenyl ether diisocyanate is a product to which access is difficult on a commercial scale and which is costly.

The present invention relates to a process for obtaining yarns and fibres based on polyamide-imides by spinning from a solution of a polymer in dimethylalkyleneurea, the polymer comprising:

amide-imide chain sequences (A) of formula:

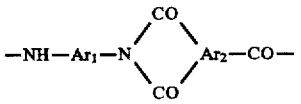

optionally amide chain sequences (B) of formula:

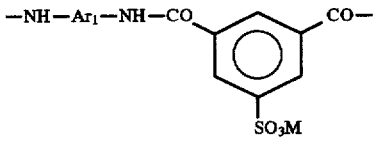

optionally amide chain sequences (C) of formula:

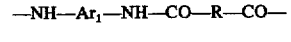

imide chain sequences (D) of formula:

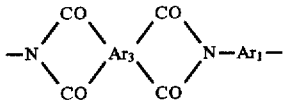

in which:

$Ar_1$ denotes a tolylene and/or meta-phenylene divalent aromatic radical, $Ar_2$ denotes a trivalent aromatic radical, $Ar_3$ denotes a tetravalent aromatic radical, R denotes a divalent aromatic radical, M denotes an alkali metal or alkaline-earth metal, the chain sequences (A) being present in a proportion of 0 to 100%, preferably 20 to 100%, the chain sequences (B) being present in a proportion of 0 to 5%, the chain sequences (C) being present in a proportion of 0 to <100%, preferably 0 to 80%, the chain sequences (D) being present in a proportion of 0 to <100%, preferably 0 to 80%, the sum of the chain sequences (A)+(B)+(C)+(D) being equal to 100%, in an aqueous coagulating medium containing 30 to 80%, preferably 50 to 65%, by weight of dimethylalkyleneurea (DMAU), drawing the filaments obtained to a ratio of at least 2×, removal of the residual solvent, drying by any known means, overdrawing to a ratio of at least 2×, preferably at least 3×, at a temperature of at least 250° C., generally at least 300° C. or even higher, the total draw ratio being at least 5×, preferably at least 6×.

The polyamide-imide employed preferably has an inherent viscosity ≧0.8 dl/g.

The dimethylalkyleneurea employed is preferably dimethylethyleneurea or dimethylpropyleneurea.

The yarns and fibres according to the present invention can also be prepared by dry spinning from a solution at a concentration of 15 to 35%, preferably 20 to 30%, in dimethylalkyleneurea of a polyamide-imide containing the chain sequences of a copolymer A, B, C and D of the formula described above, with $Ar_1$, $Ar_2$, $Ar_3$, R and M having the same meaning, into an evaporation atmosphere maintained at a temperature close to or higher than the boiling point of the solvent, the filaments at the exit of the evaporation vessel being freed from their residual solvent. For this purpose they may be washed with water, optionally boiling and under pressure, and dried in a conventional manner, preferably at a temperature above 80° C. They may also be heat-treated at a temperature ≧160° C. at reduced pressure and/or under inert atmosphere; after being freed from their residual solvent they are drawn at a temperature above 250° C., preferably above 300° C., preferably in the absence of oxygen.

The total draw ratio applied is at least 5×, preferably at least 6×.

Such polymers can be obtained by reaction (a), in substantially stoichiometric proportions and in the absence of catalyst, in an anhydrous polar solvent, of at least one aromatic diisocyanate chosen from 2,4-tolylene or 2,6-tolylene diisocyanate or meta-phenylene diisocyanate with at least one acidic reactant comprising an aromatic acid anhydride, optionally an aromatic dianhydride, optionally an alkali or alkaline-earth metal 3,5-dicarboxybenzenesulphonate, and optionally an aromatic diacid, under the operating conditions described in French Patent Application 1,600,067 filed on 30 Dec. 1968.

These polymers can also be obtained by reaction (b) of the diisocyanate(s) referred to above and of an acidic reactant comprising an aromatic dianhydride, and an aromatic diacid, optionally of an alkali or alkaline-earth metal 3,5-dicarboxybenzene sulphonate, in the absence of aromatic acid anhydride, in stoichiometric proportions and in the absence of catalyst.

When reaction (a) is employed the proportions of the various chain sequences are the following:

chain sequences (A): 20 to 100% chain sequences (B): 0 to 5% chain sequences (C): 0 to 80% chain sequences (D): 0 to 80%

When reaction (b) is employed the proportions of the chain sequences are the following:

chain sequences (A): 0% chain sequences (B): 0 to 5% chain sequences (C): 0 to 80%, preferably 0 to 75% chain sequences (D): 20 to 100%, preferably 20 to 80%.

The sum of the chain sequences (A)+(B)+(C)+(D)=100%.

The diisocyanates which can be employed for obtaining the polyamide-imides are 2,4- or 2,6-tolylene diisocyanates and meta-phenylene diisocyanate or mixtures thereof. In the trade tolylene diisocyanate takes the form of a mixture of 2,4- and 2,6-tolylene (2,4- and 2,6-TDI) isomers. It is preferable that the mixture should consist of at least 60% of 2,4-TDI.

A minor proportion of another aromatic, aliphatic or cycloaliphatic diisocyanate may be optionally added to the abovementioned diisocyanates with the aim of improving certain properties of the manufactured articles, for example, it may be advantageous to replace up to 30% of m-PDI with para-phenylene diisocyanate (p-PDI) to improve the mechanical properties of the fibres obtained.

The acidic anhydride employed is preferably trimellitic anhydride and, as aromatic dianhydride there may be mentioned the dianhydrides of pyromellitic acid, of 3,3',4,4'-diphenyltetracarboxylic acid, of 2,3,6,7-naphthalenetetracarboxylic acid, of diphenyl ether 3,3',4,4'-tetracarboxylic acid, of diphenyl sulphone 3,3',4,4'-tetracarboxylic acid and, preferably, the dianhydride of diphenyl ketone 3,3',4,4'-tetracarboxylic acid. A number of these dianhydrides may be employed as a mixture; and, among aromatic diacids, terephthalic and isophthalic acids are frequently employed and, although terephthalic acid is preferred, other diacids may be suitable, such as biphenyldicarboxylic or naphthalenedicarboxylic acids. The trimellitic anhydride employed must be pure and in particular must not contain more than 5 mol % of trimellitic acid.

The alkali or alkaline-earth metal 3,5-dicarboxybenzenesulphonate is preferably the sodium or potassium sulphonate.

The various acid or acid anhydride and dianhydride compounds are present in the following molar proportions:

aromatic acid anhydride: from 0 to 100% relative to the total of the acidic reactants, preferably 20 to 100%, aromatic diacid: from 0 to <100%, preferably from 0 to 80%, dicarboxybenzenesulphonate in a proportion of 0 to 5%.

aromatic dianhydride: from 0 to <100% relative to the total of the acidic reactants. The polymers thus obtained preferably have an inherent viscosity of at least 0.8 dl/g, preferably at least 0.9 dl/g in order to be capable of being spun and to yield yarns exhibiting good mechanical properties.

Below these viscosity values, which correspond to insufficient molecular masses, the yarns obtained are difficult to use.

The polyamide-imides also have a glass transition temperature of at least 290° C., generally higher than 300° C., and this contributes to yarns with good thermomechanical behaviour being obtained. The inherent viscosity represents the measurement of the flow time of a solution of polymer at a concentration of 0.5% (weight/volume) in DMEU at 25% in a capillary of 0.8 mm diameter.

$$\eta=4.6\ (\log t1-\log t0)$$

t0 (in s) being the flow time of the pure solvent t1 (in s) being the flow time of the solution.

Among the polar organic solvents which can be employed, use is made of dimethylalkyleneurea, for example dimethylethyleneurea or dimethylpropyleneurea, and the solutions of polyamide-imides to be spun have the advantage of being faintly coloured. In addition, they must exhibit a viscosity allowing them to be spun, generally between 400 and 1000, preferably 500 and 800 poises, measured by means of a viscometer known in the trade under the mark Epprecht Rheomat 15, for wet spinning, and 1500 to 3000 poises for dry spinning.

The spinning solution may have a polymer concentration of between 10 and 35%, preferably between 15 and 25%. It may contain various adjuvants intended to modify the appearance or the final properties of the yarns obtained, such as colorants, delustring agents, stabilisers, etc.

The temperature of the spinning solution may vary within wide limits depending on the viscosity of the solution to be spun. For example, a solution exhibiting a low viscosity can be easily extruded at normal temperature, whereas it is preferable to extrude a solution of high viscosity with heating, for example at 120° C. or even higher, to avoid using excessive die pressures.

In the case of wet spinning the coagulating bath employed in the process according to the invention is an aqueous solution containing from 30 to 80% by weight of dimethylalkyleneurea (DMAU) although it is frequently advantageous to employ a bath containing more than 50% of DMAU to obtain filaments with better drawability and hence better final properties.

The speed at which the filaments run through the coagulating bath can vary within wide limits as a function of its solvent concentration and of the distance the filaments travel in this bath. This running speed of the filaments in the coagulating bath can be easily chosen, for example between 10 and 60 mm/min, although higher speeds can be reached. There is generally no advantage in spinning at lower speeds because of process profitability reasons. Furthermore, excessive running speeds of the filaments in the coagulating bath reduce the drawability of the filaments in air. The speed at which the filaments run through the coagulating bath will therefore be chosen to take account both of profitability and of the desired qualities of the finished yarn.

The temperature of the coagulating bath may be chosen between, for example, 15° and 40° C.; it is generally between 20° and 30° C.

The filaments thus obtained are then drawn, preferably in air, to a ratio of at least 2× or more.

After drawing, preferably in air, which is generally carried out by passing between two series of rolls, the residual solvent is removed from the filaments by known means, generally by washing with water circulating countercurrent-wise or on washing rolls, at room temperature.

The yarns obtained by dry spinning are predrawn in the spinning cell and the residual solvent is then removed either by heat treatment at a temperature above 100° C. or by washing with water, preferably with boiling water under pressure.

In both spinning processes the washed filaments are then dried by known means, for example in a drier or on rolls. The temperature of this drying can vary within wide limits, as well as the speed, which is proportionally greater the higher the temperature. It is generally advantageous for drying to be performed with a progressive rise in temperature, it being possible for this temperature to reach and even exceed 200° C., for example.

The filaments from which the solvent and water have been removed are subjected to a second drawing to improve their mechanical properties and to make it possible to attain fine linear densities, which may be lower than 1 dtex/filament.

The overdrawing is performed by any known means: oven, plate, rolls, at a temperature of at least 250° C., preferably at least 300° C. and capable of going up to 400° C., preferably in the absence of oxygen.

The overdrawing, generally carried out at a ratio of at least 2×, preferably at least 3×, capable of reaching 4 or 5×, with the result that the overall draw ratio is at least 5×, preferably at least 6×.

According to the present invention, the PAI yarns produced from tolylene diisocyanate or meta-phenylene diisocyanate have the unexpected characteristic of exhibiting an outstanding drawability and hence of making it possible to gain access to finer linear densities than the polyamide-imides produced from other diisocyanates such as 4,4'-diphenylmethane diisocyanate, or 4,4'-diphenyl ether diisocyanate, described previously in French Patents 2,079,785 and 2,643,084. They also have the advantage of lower colouring and, above all, of better thermomechanical behaviour, as will be seen later in the description.

The present invention also relates to yarns and fibres based on polyamide-imides consisting of amide-imide chain sequences (A) of formula:

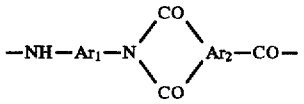

optionally amide chain sequences (B) of formula:

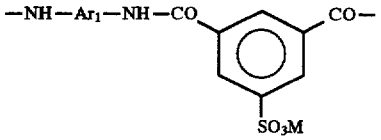

optionally amide chain sequences (C) of formula:

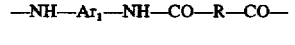

imide chain sequences (D) of formula:

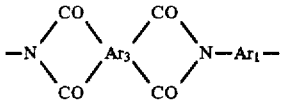

in which:

$Ar_1$ denotes a tolylene or meta-phenylene divalent aromatic radical, $Ar_2$ denotes a trivalent aromatic radical, $Ar_3$ denotes a tetravalent aromatic radical, R denotes a divalent aromatic radical, M denotes an alkali metal or alkaline-earth metal, the chain sequences (A) being present in a proportion of 20 to 100%, preferably 50 to 100%, the chain sequences (B) being present in a proportion of 0 to 5%, the chain sequences (C) being present in a proportion of 0 to <100%, preferably 0 to 50%, the chain sequences (D) being present in a proportion of 0 to 100%, preferably 20 to 100%, the sum of the chain sequences A+B+C+D being equal to 100%, which have an outstanding thermomechanical behaviour and a weak colour.

The yarns and fibres according to the invention preferably have an inherent viscosity ≧0.8 dl/g, preferably 0.9 dl/g.

The thermomechanical behaviour is demonstrated by the retention of the value of the modulus of elasticity during a linear rise in temperature with a change in the temperatures ranging approximately from 50° to 400° C. The retention of the modulus of elasticity is ≧40% at 310° C., preferably ≧50%. The yarns produced from PAI based on tolylene diisocyanate exhibit particularly high thermomechanical behaviour. Yarns based on PAI produced from m-PDI, for their part, exhibit a very weak initial colouring, enabling them to be dyed in very light shades, which are uncommon in products of this type.

In addition, they have an at least 75%, preferably at least 80%, retention of tenacity after 1000 hours' exposure at 200° C. and at least 65% preferably at least 70%, after 5000 hours' exposure at 200° C.

The yarns according to the invention also exhibit an excellent drawability which makes it possible to reach very low linear densities, lower than 1 dtex/filament, which is quite uncommon in the case of thermally stable yarns and which endows them with a very soft textile feel. They also have outstanding mechanical properties, fracture toughness, modulus of elasticity and a low elongation. They thus combine a textile feel and good mechanical and thermomechanical characteristics. They can be easily dyed with basic dyes.

They can be employed by themselves or mixed with natural or synthetic yarns with the aim of improving or modifying certain properties. They find their use in a wide range of applications, in particular work and protective clothing.

When the yarns are free from units (B) they can also form part of the composition of many composites, especially for dielectric applications.

Finally, they have a considerable economic advantage because tolylene diisocyanate and meta-phenylene diisocyanate are known for their accessibility and their relatively low market price, and this represents a considerable industrial advantage; this is particularly significant in comparison with the yarns produced from polyamide-imides prepared from 4,4'-diphenyl ether diisocyanate.

In the examples which follow, the values of $\overline{Mw}$ and $\overline{Mn}$ are determined by gel exclusion chromatography (GPC) in NMP at 80° C. and 0.1 mole/liter of lithium bromide, the masses being expressed in relation to a polystyrene calibration.

The polydispersity index I corresponds to the ratio $\overline{Mw}/\overline{Mn}$.

EXAMPLES 1 TO 4 (TDI)

A solution containing 21% of a sulphonated copolyamide-imide in dimethylethyleneurea is prepared by reaction, in the absence of catalyst of:

| | | |
|---|---|---|
| DMEU | 257.1 g | 244 ml |
| tolylene diisocyanate | 87 g | 0.5 mol |
| trimellitic anhydride | 76.8 g | 0.4 mol (80 mol %) |
| terephthalic acid (TA) | 13.28 g | 0.08 mol (16 mol %) |
| sodium 3,5-dicarboxybenzene-sulphonate | 5.36 g | 0.02 mol (4 mol %) |
| DMEU diluent | 263.7 g | 250 ml |
| Molecular mass $\overline{Mn}$: | 50,020 | |
| Polydispersity I: | 1.78 | |
| Inherent viscosity: | 0.97 dl/g | |

A solution at a concentration of 21% is obtained, with a viscosity of 603 poises, measured with an Epprecht Rheomat 15 viscometer. Vessel D+E at 25° C.

The solution, maintained at a temperature of 70° C., is extruded through a die comprising 62 orifices of 0.06-mm diameter, into a DMEU/water coagulating bath containing 62% by weight of DMEU and 38% by weight of water, maintained at 27° C., the distance travelled by the filaments in this bath being approximately 1 meter. On leaving the coagulating bath the filaments are taken up by a first set of rolls and drawn in air between the first and the second set of rolls to a ratio of 2×. They are then washed countercurrent-wise with water in a washing tank, dried in an oven maintained at approximately 150° C. and are then over-drawn in an oven maintained at a temperature of approximately 350° C.

A number of overdraw ratios were used. The characteristics of the yarns are combined in Table I which follows:

TABLE I

| | EXAMPLE 1 | EXAMPLE 2 | EXAMPLE 3 | EXAMPLE 4 |
|---|---|---|---|---|
| Overdraw ratio | 4.5 | 3.5 | 4 | 4.2 |
| Overall ratio | 9 | 7 | 8 | 8.4 |
| Linear density (dtex) | 1.03 | 1.03 | 1.21 | 0.87 |
| Fracture toughness g/tex | 21.6 | 24.7 | 18.7 | 23.3 |
| Elongation at break % | 16.2 | 15.7 | 17.8 | 17.6 |

Thermal behaviour

Retention of tenacity after 1000 hours' exposure at 200° C.=80% and, after 5000 hours at 200° C.=70%.

A yarn obtained according to FR 2,643,084, consisting of a polyamide-imide produced from the same monomers as above, except for tolylene diisocyanate which has been replaced with 4,4'-diphenylmethane diisocyanate, has a retention of tenacity after exposure for 1000 hours at 200° C.=38%.

Thermomechanical behaviour: retention of the modulus of elasticity as a function of temperature:

the fibre retains 50% of its modulus at 310° C., a fibre prepared according to FR 2,643,084, based on 4,4'-diphenylmethane diisocyanate retains only 22.5% of its modulus at 310° C.

EXAMPLE 5

A polyamide-imide is prepared as indicated in Example 1, TDI being replaced with meta-phenylene diisocyanate in an identical molar proportion.

The PAI obtained has the molecular mass $\overline{Mn}$: 36,560 and the polydispersity index: 2.05 and has an inherent viscosity of 0.86 dl/g.

The viscosity of the solution, measured with an Epprecht Rheomat viscometer is 566 poises.

The polyamide-imide solution thus obtained, with a concentration of 21%, is spun and treated as indicated in Example 1, the air drawing being carried out to a ratio of 2.3× and the overdrawing also to a ratio of 2.3×, the overall draw ratio being 5.29×.

The yarns obtained exhibit the following characteristics:

| | |
|---|---|
| linear density (dtex) | 2.3 |
| fracture toughness | 26 g/tex |
| elongation at break | 18% |
| retention of tenacity after heat aging for 1000 hours at 250° C. | 75% |
| thermomechanical behaviour | retention of the modulus of elasticity at 310° C.: 40%. |

EXAMPLES 6 TO 8

Kermel based on TDI with 40% of TA

A solution containing 21% of a sulphonated copolyamide-imide in dimethylethyleneurea is prepared by reaction of:

| | | |
|---|---|---|
| DMEU | 251.3 g | 238 ml |
| tolylene diisocyanate | 87 g | 0.5 mol |
| trimellitic anhydride | 53.76 g | 0.28 mol (56 mol %) |
| terephthalic acid (TA) | 33.20 g | 0.20 mol (40 mol %) |
| sodium 3,5-carboxybenzene-sulphonate | 5.36 g | 0.02 mol (4 mol %) |
| DMEU diluent | 257.40 g | 244 ml |
| Molecular mass $\overline{Mn}$: | 40,560 | |
| Polydispersity I: | 1.98 | |
| Inherent viscosity: | 0.95 dl/g | |

A solution is obtained with a viscosity of 606 poises, measured with an Epprecht Rheomat 15 viscometer. Vessel D+E at 25° C.

The solution, maintained at a temperature of 70° C., is extruded through a die comprising 62 orifices of 0.06-mm diameter, into a DMEU/water coagulating bath containing 62% by weight of DMEU and 38% by weight of water, maintained at 27° C., the distance travelled by the filaments in this bath being approximately 1 meter. On leaving the coagulating bath the filaments are taken up by a first set of rolls and drawn in air between the first and the second set of rolls to a ratio of 2×. They are then washed countercurrent-wise with water in a washing tank, dried in an oven maintained at approximately 150° C. and are then over-drawn in an oven maintained at a temperature of approximately 350° C.

A number of overdraw ratios were used. The characteristics of the yarns are combined in Table II which follows:

TABLE II

| | EXAMPLE 6 | EXAMPLE 7 | EXAMPLE 8 |
|---|---|---|---|
| Overdraw ratio | 4.65 | 4 | 3 |
| Overall ratio | 9.4 | 8.08 | 6.06 |
| Linear density (dtex) | 0.92 | 0.96 | 1.47 |
| Fracture toughness g/tex | 28.2 | 29.4 | 23 |
| Elongation at break % | 26.4 | 26.1 | 36.8 |

EXAMPLE 9

A solution containing 21% of a sulphonated copolyamide in dimethylpropyleneurea is prepared by reaction, in the absence of catalyst, of:

| | |
|---|---|
| dimethylpropyleneurea (DMPU) | 279.8 g (d = 1.064) = 263.0 ml |
| trimellitic anhydride | 61.44 g (0.32 mol) |
| terephthalic acid | 13.28 g (0.08 mol) |
| 1,3-phenylene diisocyanate | 64 g (0.4 mol) |
| DMPU diluent | 109.6 g 103 ml |

A solution at a concentration of 21% in DMPU is obtained, with a viscosity of 810 poises, measured as indicated in Example 1. The PAI thus obtained has a molecular mass Mn=37,840, a polydispersity of 2.34 and an inherent viscosity of 0.89 dl/g.

The solution thus obtained is spun as indicated in Example 1 and the filaments obtained are drawn to a draw ratio of 2×, washed and dried and then overdrawn in an oven maintained at 335° C. to a ratio of 3×.

The filaments obtained have the following characteristics:

| | |
|---|---|
| Linear density (dtex) | 2 |
| Fracture toughness | 30 g/tex |
| Elongation % | 15 |

Thermomechanical behaviour—retention of the modulus of elasticity: at 310° C.: retention of 43% of the initial modulus.

EXAMPLES 10 TO 12

A solution containing 21% of a sulphonated copolyamide-imide in dimethylethyleneurea is prepared by reaction, in the absence of catalyst, of:

| | | |
|---|---|---|
| DMEU | 257.1 g | 244 ml |
| tolylene diisocyanate | 87 g | 0.5 mol |
| trimellitic anhydride | 76.8 g | 0.4 mol (80 mol %) |
| terephthalic acid (TA) | 13.28 g | 0.08 mol (16 mol %) |
| sodium 3,5-dicarboxybenzene sulphonate | 5.36 g | 0.02 mol (4 mol %) |
| DMEU diluent | 263.7 g | 250 ml |
| Molecular mass Mn: | 60,100 | |
| Polydispersity I: | 2 | |
| Inherent viscosity: | 1 dl/g | |

A solution at a concentration of 21% is obtained, with a viscosity of 603 poises, measured with an Epprecht Rheomat 15 viscometer. Vessel D+E at 25° C. In these examples the DMEU employed for the polycondensation and spinning was recycled beforehand after purification, especially by distillation.

The solution, maintained at a temperature of 70° C., is extruded through a die comprising 62 orifices of 0.065 mm diameter, into a DMEU/water coagulating bath containing 62% by weight of DMEU and 38% by weight of water, maintained at 28° C., the distance travelled by the filaments in this bath being approximately 1 meter. On leaving the coagulating bath the filaments are taken up by a first set of rolls and drawn in air between the first and the second set of rolls to a ratio of 2.5×. They are then washed countercurrentwise with water in a washing tank, dried in an oven maintained at approximately 120° C. and are then overdrawn in an oven maintained at a temperature of approximately 370° C.

A number of overdraw ratios were applied. The characteristics of the yarns are combined in Table I which follows:

TABLE III

| | EXAMPLE 10 | EXAMPLE 11 | EXAMPLE 12 |
|---|---|---|---|
| Overdraw ratio | 4 | 4.5 | 5 |
| Overall ratio | 10 | 11.25 | 12.5 |
| Linear density (dtex) | 1.35 | 1.36 | 1.34 |
| Fracture toughness g/tex | 31.7 | 33.2 | 34.8 |
| Elongation at break % | 25.3 | 23.6 | 21.3 |

Thermomechanical behaviour: retention of the modulus of elasticity as a function of temperature:

the fibre retains 50% of its modulus at 310° C.

EXAMPLES 13 AND 14

A solution containing 21% of a copolyamide-imide in dimethylethyleneurea is prepared by reaction, in the absence of catalyst, of:

| | |
|---|---|
| tolylene diisocyanate | 0.5 mol |
| trimellitic anhydride | 0.4 mol (80 mol %) |
| terephthalic acid (TA) | 0.10 mol (20 mol %) |
| inherent viscosity | 0.97 dl/g. |

The solution, maintained at a temperature of 70° C., is extruded through a die comprising 62 orifices of 0.065-mm diameter, into a DMEU/water coagulating bath containing 62% by weight of DMEU and 38% by weight of water, maintained at 28° C., the distance travelled by the filaments in this bath being approximately 1 meter. On leaving the coagulating bath the filaments are taken up by a first set of rolls and drawn in air between the first and the second set of rolls to a ratio of 2.2×. They are then washed countercurrentwise with water in a washing tank, dried in an oven maintained at approximately 120° C. and are then overdrawn in an oven maintained at a temperature of approximately 350° C.

A number of overdraw ratios were used. The characteristics of the yarns are combined in Table IV which follows:

TABLE IV

| | EXAMPLE 13 | EXAMPLE 14 |
|---|---|---|
| Overdraw ratio | 3 | 3.5 |
| Overall ratio | 7 | 7.7 |
| Linear density (dtex) | 2.07 | 1.88 |
| Fracture toughness g/tex | 31 | 32.3 |
| Elongation at break % | 21.5 | 19.1 |

Aging test.

Thermomechanical behaviour: retention of the modulus of elasticity as a function of temperature the fibre retains 50% of its modulus at 310° C.

EXAMPLES 15 TO 17

A solution containing 25% of a copolyamide-imide in dimethylethyleneurea is prepared by reaction, in the absence of catalyst, of:

| | |
|---|---|
| dimethylethyleneurea (DMEU): | 269.3 g (d = 1.056) = 255 ml |
| benzophenonetetracarboxylic anhydride: | 80.5 g (0.25 mol) (50 mol %) |
| terephthalic acid: | 41.5 g (0.25 mol) (50 mol %) |
| tolylene diisocyanate: | 87 g (0.50 mol) |
| DMEU diluent: | 185.7 g (176 ml) |

A solution at a concentration of 21% in DMEU is obtained, with a viscosity of 580 poises, measured as indicated in Example 1. The PAI thus obtained has a molecular mass $\overline{Mn}$=36250 and a polydispersity of 2.10.

Inherent viscosity: 0.85 dl/g.

The solution thus obtained is spun as indicated in Example 1 and the filaments obtained are drawn to a draw ratio of 2.2×, washed and dried and then overdrawn in an oven maintained at 345° C.

Several overdraw ratios were applied. The characteristics of the yarns are combined in Table V which follows.

TABLE V

| | EXAMPLE 15 | EXAMPLE 16 | EXAMPLE 17 |
|---|---|---|---|
| Overdraw ratio | 2.5 | 3 | 3.5 |
| Overall ratio | 5.5 | 6.6 | 7.7 |
| Linear density (dtex) | 2 | 1.7 | 1.4 |
| Fracture toughness g/tex | 25.3 | 28.2 | 31.3 |
| Elongation at break % | 25 | 18 | 15 |

EXAMPLE 18

A solution containing 27% of a polymer in dimethylethyleneurea is prepared by reaction in the absence of catalyst of:

dimethyleneurea (DMEU): 276 g benzophenonetetracarboxylic dianhydride: 80.5 g (0..25 mol)

toluylene diisocyanate: 43.5 g (0.25 mol).

A solution at a concentration of 21% in DMEU is obtained by adding 108 g of DMEU. This solution has a viscosity of 0.98 dl/g, measured as indicated in example 1. The polymer thus obtained has a molecular weight $\overline{Mn}$=43150 and a polydispersity of 3.50.

The solution is spun as indicated in example 1 and the filaments obtained are drawn, washed and dried and then overdrawn in an oven maintained at 370° C.

EXAMPLE 19

A solution containing 21% of a copolyamide imide in dimethylethyleneurea is prepared by reaction in the absence of catalyst, of:

tolylene diisocyanate: 0.5 mol trimellitic anhydride: 0.5 mol inherent viscosity: 0.95 dl/g.

The solution, maintained at a temperature of 70° C., is extruded through a die comprising 62 orifices of 0.065 mm diameter, into a DMEU/water coagulating bath containing 45% by weight of DMEU and 55% by weight of water, maintained at 15° C., the distance travelled by the filaments in this bath being approximately 1 meter. On leaving the coagulating bath the filaments are taken up by a first set of rolls and drawn in air between the first and the second set of rolls to a ratio of 1.8×. They are then washed countercurrentwise with water in a washing tank, dried in an oven maintained at approximately 120° C. and are then overdrawn in an oven maintained at a temperature of approximately 360° C.

The characteristics of the yarns are combined in Table which follows:

| | Example 19 |
|---|---|
| overdraw ratio | 2,5 |
| overall ratio | 4,5 |
| linear density (dtex) | 2,13 |
| fracture toughness cN/tex | 30,3 |
| elongation at break % | 36,9 |

EXAMPLE 20

In a 110 liters reactor were added 49.9 liters of recycled DMEU, 12400 g of Toluylene diisocyanate, 10947 g of trimellitic anhydride and 2366 g of terephthalic acid. The mixture was heated to 186° C. and maintained for 70 minutes. Then, the heating was stopped and 24 liters of recycled DMEU were added as diluting solvent. The viscosity of the dope was 800 poises at 25° C. and the polymer concentration was 20.1% by weight.

This dope was extruded through spinnerets with 10000 holes of 55 μm diameter, into a DMEU/Water coagulating bath containing 60% by weight of DMEU. The coagulating bath was maintained at a temperature below 20° C.

After coagulation, the filaments were drawn in air to a 1.8 ratio. They are washed with water and then dried in an oven maintained at 140° C. After drying, the filaments are stretched at about 935° C. The stretching ratio was 2.7.

The filaments had the following characteristics:

linear density: 1.8 dtex tensile strength: 39.6 cN/tex elongation at break: 32.6% modulus of elasticity: 397.1 cN/tex

The recycling of the DMEU was carried out by collecting it after the washing step in the spinnering process. The collected DMEU contained a high quantity of water (65% by weight). Water and DMEU were separated by distillation. The DMEU collected after distillation and recycled for the polycondensation step has a water content of less than 500 ppm.

The foregoing example is directed to the use of recycled dimethethylene urea as solvent for the polycondensation as well as the dilution solvent and is illustrative of the industrial process.

We claim:

1. A process for obtaining yarns and fibres based on polyamide-imide, which have an improved thermomechanical behavior, comprising:

a) spinning a solution of a polymer having an inherent viscosity ≧0.8 dl/g in dimethylalkyleneurea (DMAU) into an aqueous coagulating medium containing 30 to 80% by weight of dimethylalkyleneurea (DMAU) and from 20 to 70% by weight of water to form filaments, said polymer made by mixing metaphenylene diisocyanate with at least one acidic reactant, selected from the group consisting of aromatic acid anhydride and aromatic diacid, and 3,5-dicarboxybenzenesulphonate, said polymer comprising:

amide-imide chain sequences (A) of formula:

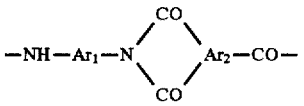

amide chain sequences (B) of formula:

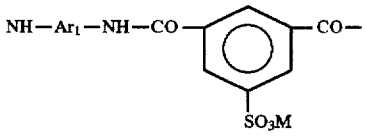

amide chain sequences (C) of formula:

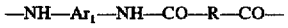

imide chain sequences (D) of formula:

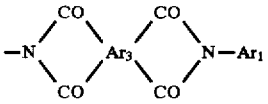

in which:

$Ar_1$ denotes a meta-phenylene divalent aromatic radical, $Ar_2$ denotes a trivalent aromatic radical, $Ar_3$ denotes a tetravalent aromatic radical, R denotes a divalent aromatic radical, M denotes an alkali metal or alkaline-earth metal, the chain sequences (A) being present in a proportion of 20 to 100%, the chain sequences (B) being present in a proportion of 0 to 5%, the chain sequences (C) being present in a proportion of 0 to <100%, the chain sequences (D) being present in a proportion of 0 to 100%, the sum of the chain sequences (A)+(B)+(C)+(D) being equal to 100%, b) drawing the filaments obtained to a ratio of at least 2×, c) removing the residual solvent from the filaments and drying the filaments, and d) overdrawing the filaments at a temperature of at least 250° C., to a ratio of at least 2×, with the result that the total draw ratio is at least 5×.

2. The process according to claim 1, wherein the solvent is removed by washing, wherein the aromatic acid anhydride comprises trimellitic anhydride and the aromatic diacid comprises terephthalic acid and the 3,5-dicarboxybenzenesulphonate is selected from the group consisting of alkali 3,5-dicarboxybenzenesulphonate and alkaline-earth metal 3,5-dicarboxybenzenesulphonate.

3. The process according to claim 1, wherein the coagulating bath contains 50 to 65% by weight of solvent.

4. The process according to claim 1, wherein the overdrawing is performed to a ratio of at least 3×, with the result that the total draw is 6×.

5. The process according to claim 1, wherein the overdrawing is performed at a temperature of at least 300° C., in the absence of oxygen.

6. A process for obtaining yarns and fibres based on polyamide-imide, which have an improved thermomechanical behavior, comprising:

a) forming a polymer from a reaction mixture of metaphenylene diisocyanate, with at least one acidic reactant, selected from the group consisting of aromatic acid anhydride and aromatic diacid, and 3,5-dicarboxybenzenesulphonate, b) spinning a spinable solution of the polymer, the polymer having an inherent viscosity ≧0.8 dl/g, in dimethylalkyleneurea (DMAU) into an evaporative atmosphere, said polymer comprising:

amide-imide chain sequences (A) of formula:

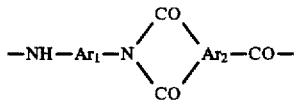

amide chain sequences (B) of formula:

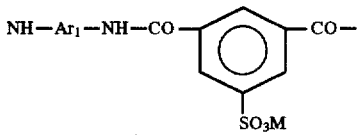

amide chain sequences (C) of formula:

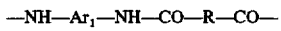

imide chain sequences (D) of formula:

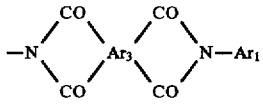

in which:

$Ar_1$ denotes a meta-phenylene divalent aromatic radical, $Ar_2$ denotes a trivalent aromatic radical, $Ar_3$ denotes a tetravalent aromatic radical, R denotes a divalent aromatic radical, M denotes an alkali metal or alkaline-earth metal, the chain sequences (A) being present in a proportion of 20 to 100%, the chain sequences (B) being present in a proportion of 0 to 5%, the chain sequences (C) being present in a proportion of 0 to 80%, the chain sequences (D) being present in a proportion of 0 to 80%, the sum of the chain sequences (A)+(B)+(C)+(D) being equal to 100%, said evaporative atmosphere being maintained at a temperature close to or higher than the boiling point of the solvent, removing the residual solvent from the filaments, and drawing the filaments at a temperature above 250° C., with the result that the total draw ratio is at least 5×.

7. The process according to claim 6, wherein the residual solvent is removed from the filaments by heat treatment at a temperature ≧160° C.

8. The process according to claim 6, wherein the residual solvent is removed from the filaments by washing with boiling water under pressure and drying in the usual manner.

9. The process according to claim 6, wherein the drawing is performed at a temperature of at least 300° C.

10. The process according to claim 6, wherein the polyamide-imide has an inherent viscosity of ≧0.9 dl/g.

11. Thermally stable yarns and fibres based on polyamide-imides formed from a reaction mixture of metaphenylene diisocyanate, with at least one acidic reactant selected from the group consisting of aromatic acid anhydride and aromatic diacid, and 3,5-dicarboxybenzenesulphonate, said polyamide-imides comprising:

amide-imide chain sequences (A) of formula:

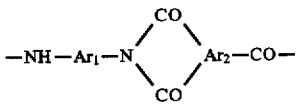

amide chain sequences (B) of formula:

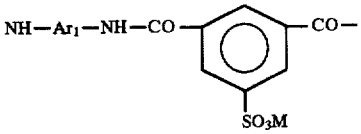

amide chain sequences (C) of formula:

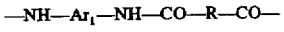

imide chain sequences (D) of formula:

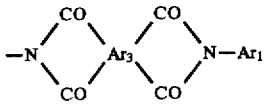

in which:

$Ar_1$ denotes a meta-phenylene divalent aromatic radical, $Ar_2$ denotes a trivalent aromatic radical, $Ar_3$ denotes a tetravalent aromatic radical, R denotes a divalent aromatic radical, M denotes an alkali metal or alkaline-earth metal, the chain sequences (A) being present in a proportion of 20 to 100%, the chain sequences (B) being present in a proportion of 0 to 5%, the chain sequences (C) being present in a proportion of 0 to 80%, the chain sequences (D) being present in a proportion of 0 to 80%, the sum of the chain sequences (A)+(B)+(C)+(D) being equal to 100%, and in that they have an at least 40% retention of the modulus of elasticity at 310° C.

12. The yarns and fibres according to claim 11, wherein the polyamide-imide has an inherent viscosity ≧0.9 dl/g.

13. The yarns and fibres according to claim 11, wherein the chain sequences (A) are present in a proportion of 50 to 100%, the chain sequences (B) in a proportion of 0 to 3%, the chain sequences (C) in a proportion of 0 to 50% and the chain sequences (D) in a proportion of 0 to 50%.

14. The yarns and fibres according to claim 11, wherein $Ar_2$ is a radical of formula

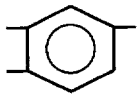

15. The yarns and fibres according to claim 11, wherein R is a radical of formula

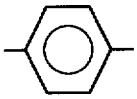

16. The yarns and fibres according to claim 11, wherein M is an alkali metal.

17. The yarns and fibres according to claim 11, wherein the retention of the modulus of elasticity is at least 50%.

18. The yarns and fibres according to claim 11, wherein the yarns and fibres have a linear density ≦1 dtex.

19. Thermally stable articles comprising yarns and fibres according to claim 11.

20. The process according to claim 6, wherein the inherent viscosity of the polyamide-imide is ≧0.9 dl/g.

21. The process according to claim 1, wherein the acidic reactant is 20 to 100% aromatic acid anhydride and at most 80% aromatic diacid and at most 5% 3,5-dicarboxybenzenesulphonate.

22. The process according to claim 21, wherein the acid reactant is 20 to 100% trimellitic anhydride and at most 80% terephthalic acid and at most 5% the 3,5-dicarboxybenzenesulphonate, wherein the 3,5-dicarboxybenzenesulphonate is an alkali 3,5-dicarboxybenzene sulphonate.

23. The process according to claim 22, wherein the 3,5-dicarboxybenzenesulphonate is selected from the group consisting of sodium 3,5-dicarboxybenzene sulphonate and potassium 3,5-dicarboxybenzene sulphonate.

24. The process according to claim 22, wherein the 3,5-dicarboxybenzenesulphonate is sodium 3,5-dicarboxybenzene sulphonate.

25. The process according to claim 6, wherein the acidic reactant is 20 to 100% aromatic acid anhydride and at most 80% aromatic diacid and at most 5% 3,5-dicarboxybenzenesulphonate.

26. The process according to claim 6, wherein the aromatic acid anhydride comprises trimellitic anhydride and the aromatic diacid comprises terephthalic acid and the 3,5-dicarboxybenzenesulphonate is selected from the group consisting of alkali 3,5-dicarboxybenzene sulphonate and alkaline-earth metal 3,5-dicarboxybenzene sulphonate.

27. The process according to claim 26, wherein the acidic reactant is 20 to 100% trimellitic anhydride and at most 80% terephthalic acid and at most 5% the 3,5-dicarboxybenzenesulphonate, wherein the 3,5-dicarboxybenzenesulphonate is an alkali 3,5-dicarboxybenzene sulphonate.

28. The process according to claim 27, wherein the 3,5-dicarboxybenzenesulphonate is selected from the group consisting of sodium 3,5-dicarboxybenzene sulphonate and potassium 3,5-dicarboxybenzene sulphonate.

29. The process according to claim 27, wherein the 3,5-dicarboxybenzenesulphonate is sodium 3,5-dicarboxybenzene sulphonate.

30. The process according to claim 11, wherein the acidic reactant is 20 to 100% aromatic acid anhydride and at most 80% aromatic diacid and at most 5% 3,5-dicarboxybenzenesulphonate.

31. The process according to claim 11, wherein the aromatic acid anhydride comprises trimellitic anhydride and the aromatic diacid comprises terephthalic acid and the 3,5-dicarboxybenzenesulphonate is selected from the group consisting of alkali 3,5-dicarboxybenzenesulphonate and alkaline-earth metal 3,5-dicarboxybenzenesulphonate.

32. The process according to claim 31, wherein the acidic reactant is 20 to 100% trimellitic anhydride and at most 80% terephthalic acid and at most 5% the 3,5-dicarboxybenzenesulphonate, wherein the 3,5-dicarboxybenzenesulphonate is an alkali 3,5-dicarboxybenzenesulphonate.

33. The process according to claim 32, wherein the 3,5-dicarboxybenzenesulphonate is selected from the group consisting of sodium 3,5-dicarboxybenzenesulphonate and potassium 3,5-dicarboxybenzenesulphonate.

34. The process according to claim 32, wherein the 3,5-dicarboxybenzenesulphonate is sodium 3,5-dicarboxybenzenesulphonate.

35. A process for obtaining yarns and fibres based on polyamide-imide, which have an improved thermomechanical behavior, comprising:

a) spinning a solution of a polymer having an inherent viscosity ≧0.8 dl/g in dimethylalkyleneurea (DMAU) into an aqueous coagulating medium containing 30 to 80% by weight of dimethylalkyleneurea (DMAU) and from 20 to 70% by weight of water to form filaments, said polymer made by mixing metaphenylene diisocyanate with at least one acidic reactant, selected from the group consisting of aromatic acid dianhydride and aromatic diacid, and 3,5-dicarboxymethylsulphonate, said polymer comprising:

amide-imide chain sequences (A) of formula:

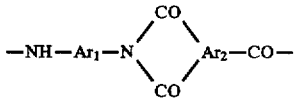

amide chain sequences (B) of formula:

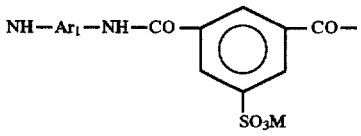

amide chain sequences (C) of formula:

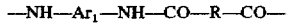

imide chain sequences (D) of formula:

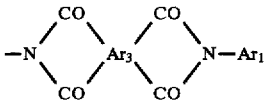

in which:

$Ar_1$ denotes a meta-phenylene divalent aromatic radical, $Ar_2$ denotes a trivalent aromatic radical, $Ar_3$ denotes a tetravalent aromatic radical, R denotes a divalent aromatic radical, M denotes an alkali metal or alkaline-earth metal, the chain sequences (A) being present in a proportion of 20 to 100%, the chain sequences (B) being present in a proportion of 0 to 5%, the chain sequences (C) being present in a proportion of 0 to <100%, the chain sequences (D) being present in a proportion of 0 to 100%, the sum of the chain sequences (A)+(B)+(C)+(D) being equal to 100%, b) drawing the filaments obtained to a ratio of at least 2×, c) removing the residual solvent from the filaments and drying the filaments, and d) overdrawing the filaments at a temperature of at least 250° C., to a ratio of at least 2×, with the result that the total draw ratio is at least 5×.

* * * * *